United States Patent [19]

Brumlik

[11] 4,201,813

[45] May 6, 1980

[54] CELLULAR LINEAR FILAMENTS WITH TRANSVERSE PARTITIONS

[76] Inventor: George C. Brumlik, 154 Upper Mountain Ave., Montclair, N.J. 07042

[21] Appl. No.: 942,097

[22] Filed: Sep. 13, 1978

Related U.S. Application Data

[60] Continuation-in-part of Ser. No. 839,082, Oct. 3, 1977, abandoned, which is a continuation of Ser. No. 649,162, Jan. 14, 1976, abandoned, which is a division of Ser. No. 262,837, Jun. 14, 1972, abandoned.

[51] Int. Cl.[2] ..... D03D 27/00; D02G 3/00

[52] U.S. Cl. ..... 428/97; 57/245; 428/85; 428/90; 428/224; 428/359; 428/369; 428/371; 428/376; 428/398; 428/400

[58] Field of Search ..... 428/398, 376, 400, 369, 428/364, 357, 359, 85, 90, 91, 92, 371, 97, 224; 57/245

[56] References Cited

U.S. PATENT DOCUMENTS

| | | | |
|---|---|---|---|
| 1,990,434 | 2/1935 | Kohler | 428/398 |
| 2,959,839 | 11/1960 | Craig | 428/398 X |
| 3,015,873 | 1/1962 | Dietzsch et al. | 428/398 X |
| 3,069,747 | 12/1962 | Adams | 428/398 |
| 3,303,045 | 2/1967 | Newman | 428/272 |
| 3,329,553 | 7/1967 | Sims et al. | 428/90 |
| 3,400,189 | 9/1968 | Nacke | 428/398 |
| 3,522,141 | 7/1970 | D'Alelio | 428/398 |
| 3,677,881 | 7/1972 | Riordon | 428/398 |
| 3,957,936 | 5/1976 | Lauchenauer | 428/398 X |
| 4,010,308 | 3/1977 | Wiczer | 428/398 X |

FOREIGN PATENT DOCUMENTS

| | | | |
|---|---|---|---|
| 343632 | 2/1931 | United Kingdom | 428/398 |

*Primary Examiner*—Lorraine T. Kendell

*Attorney, Agent, or Firm*—Sprung, Felfe, Horn, Lynch & Kramer

[57] ABSTRACT

Cellular linear filaments are disclosed and include a substantially continuous, integral plastic hollow member having internal generally transverse partitions which divide the hollow member into cells. The wall of the hollow member can be continuous or can contain orifices, slits, windows and the like. The cells can be open or closed and uniformly or randomly spaced along the tubular member. The cells are defined by transverse partitions which can be integrally formed with the hollow member or they can be seals in the hollow member. Woven, non-woven and tufted materials including yarns made up in part or in total of the cellular linear element are also disclosed. The cellular linear element can be cut into discrete lengths to form pile-like elements which can be attached upright to a base to form a multi-element device.

15 Claims, 19 Drawing Figures

CELLULAR LINEAR FILAMENTS WITH TRANSVERSE PARTITIONS

CROSS REFERENCE TO RELATED APPLICATION

This is a continuation-in-part of Ser. No. 839,082 filed Oct. 3, 1977 entitled CELLULAR LINEAR FILAMENTS WITH TRANSVERSE PARTITIONS, and now abandoned; which is a continuation of Ser. No. 649,162 filed Jan. 14, 1976, and now abandoned; which in turn is a division of Ser. No. 262,837 filed June 14, 1972, and now abandoned.

BACKGROUND

This invention relates to cellular linear filaments having uniformly or randomly spaced common open or closed contiguous cells.

Commercially available fibers, filaments and yarns are made up of natural and synthetic materials which are commonly solid in cross section. Such materials have been constructed and designed in the past for long wear in the case of garments and in addition for scuff and abrasion resistance in the case of carpets and other floor coverings. Present day architectural and design and decorating practices often call for finishes on interior and exterior surfaces other than floors or decks which involve woven, non-woven or flocked fibrous materials. Such materials call for inexpensive fibers having exceptionally high bulk/weight factors combined with excellent thermal, sound and electrical insulating properties. With the increasing use of woven and non-woven materials in these particular areas, the economics of using conventional natural and synthetic fibers and filaments in advanced design becomes very expensive.

The present invention provides linear elements which are characterized by a cellular structure which greatly increases their space-filling bulk per unit weight and provides inexpensive and material saving fibers. The fluid or gas present in closed cells of the fibers and filaments of the invention provides for a spring action which greatly increases the resiliency and compressive strength of the linear elements as well as materials and articles formed therefrom. The presence of gas filled cells within the fiber body further greatly improves the thermal, electrical and sound insulating properties of the fibers, fabrics and composites made thereof. Such gases can be chosen to suit a particular use or environment such as air, nitrogen, carbon dioxide, carbon tetrafluoride, halogenated hydrocarbon gases, sulfur hexafluoride for electrical insulation and the like. The linear elements of the invention can be used in non-woven, woven and flocked materials much in the same way as solid fibers and filaments yet give excellent appearance at a greatly reduced cost from a material standpoint and at a greatly reduced weight per unit area.

SUMMARY

The cellular linear filament of the invention comprises a substantially continuous, integral plastic hollow member having internal, generally transverse partitions which divide the member into cells. The wall of the member can be continuous or can contain orifices. Slits or windows and the cells can be opened or closed or a mixture of these can be uniformly or randomly spaced along a hollow member. The transverse partitions can be integrally formed with the hollow member or they can be seals in the hollow member itself. In a preferred embodiment the linear element is longitudinally stretched to effect molecular and crystalline orientation (drawn down) and to provide unique shapes and properties for the linear element of the invention. The linear filaments have diameters in the range of 0.0002 to 0.05 inch and can form all or part of woven and non-woven materials or yarns which are used to make woven and non-woven materials and articles. In a further embodiment the linear element can be cut into discrete lengths to form pile-like elements which are generally fiber-like in nature. These pile elements can be used to form a multi-element device by attaching a plurality of same in an upright fashion to a base by flocking for example.

DESCRIPTION OF THE DRAWINGS

FIGS. 7*a–e* are cross-sectional views showing various tube profiles for the linear element of the invention.

FIGS. 8*a–d* are cross-sectional views, FIGS. 8*b* and *c* also being partly in perspective, showing modifications that can be made in the structure of the linear element illustrated in FIGS. 2*a* and 15.

FIGS. 9*a–f* are vertical cross-sectional views of modifications that can be made in the structure of the linear element shown in FIG. 1*a*.

DESCRIPTION

Figures 1A, 1B, 2A, 2B, 3, 4, 5, 6, 7, 8, 9, 10, 11, 12, 13, 14, 15, 16, 17:
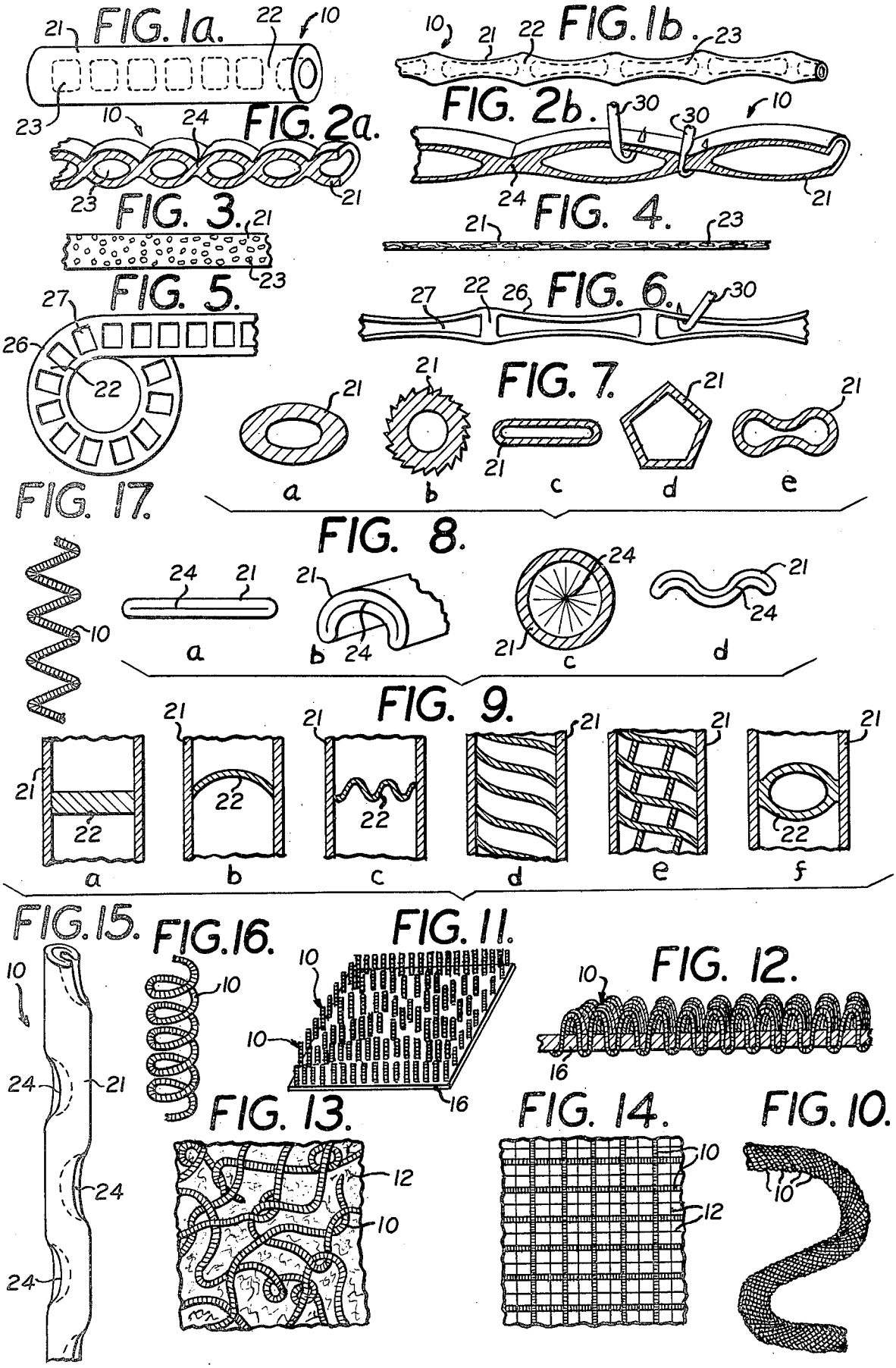
FIGS. 1*a* and *b* are side views of a cellular linear element of the invention, the cells being shown in phantom by dotted lines, and FIG. 1*b* showing the element of FIG. 1*a* longitudinally stretched and drawn down having knee-like partitions similar to bamboo.
FIGS. 2*a* and *b* are side views partly broken away of pocket-like cellular linear elements similar to the element of FIG. 1.
FIG. 2*b* shows the element of FIG. 2*a* stretched or longitudinally oriented.
FIGS. 3 and 4 are side views partly broken away of further cellular linear elements of the invention, FIG. 4 being a representation of the stretched or oriented form of the linear element shown in FIG. 3.
FIG. 5 is an end elevational view of an extruded tube having longitudinal channel tubes within the wall thereof which is adapted to be helically cut transverse to the orientation of the tubes to form a continuous linear element containing cells open to the outside of the said linear element. The resultant linear element can be stretched or oriented.
FIG. 6 is a side view partly broken away of an open cell linear element which is formed by stretching or longitudinally orienting the helically cut linear element of FIG. 5.
FIG. 10 is a top plan view partly broken away of a twisted yarn incorporating the linear element of the invention.
FIG. 11 is a perspective view of a multi-element device incorporating a plurality of pile elements formed from the linear elements of the invention.
FIG. 12 is a side elevational view partly in perspective showing a yarn incorporating the linear element of the invention woven or tufted into a base to form a carpet-like material or article.
FIGS. 13 and 14 are diagrammatic views illustrating various ways in which a linear element of the invention can be utilized as a component of a non-woven and woven material.
FIG. 15 is a side view in perspective partly broken away of a further embodiment of a linear element of the invention incorporating crescent-shaped collapsed wall seals as illustrated in FIG. 8*b*.
FIGS. 16 and 17 are elevational views schematically illustrating the linear element of the invention in the form of a spiral or helix (FIG. 16) or folded or crimped (FIG. 17).

Referring now to the drawing and in particular to FIGS. 1 and 2, the linear element of the invention is shown in one embodiment to include a substantially continuous integral plastic tube 10 having transverse partitions 22 which divide the tubular member into a series of cells 23. The cellular linear element is identified generally by the reference numeral 10. In FIG. 1*a*, the partitions 22 are integrally formed with the tubular member 21 while in FIG. 2*a* the transverse partitions 24 are seals formed by collapsing and joining the walls in the tubular member 21. As noted previously, the cells 23 can be opened to the outside of the filament wall as is for example shown in FIG. 3, cell 23, FIG. 5 cell 27 and FIG. 6 cell 27, and can be of all the same size or can vary in size or shape along the tubular member 21. It is also possible to utilize both cells open to the outside of the filament and closed cells in the same linear element.

The cellular linear element of the invention can be utilized in the same fashion as substantially continuous filaments or it can be cut into discrete lengths to form staple for spinning into yarn or to form pile for attaching in a generally upright fashion in relatively thick profusion to form a multi-element, carpet-like article as shown for example in FIG. 11.

The linear elements of the invention such as those illustrated in FIGS. 1 and 2 are formed from substantially continuous tubes 21. In FIG. 3 a foamed structure is shown having cells 23 which can be uniform or random along the tube. The linear elements can be used in substantially continuous pile form as shown in FIGS. 1*a* and 2*a* or they can be longitudinally stretched or oriented to improve or alter their properties. FIG. 1*b* shows the effect of linearly drawing down the structure of FIG. 1*a* whereby the cell walls are thinned out and knee-like partitions 22 are formed resembling bamboo. FIG. 2*b* shows a similar structure resulting from drawing down the sealed structure shown in FIG. 2*a* whereby the cell walls are thinned and the seal areas remain relatively thick.

The structure of the cellular linear elements illustrated in FIGS. 1 and 2 for example provide an air spring which aids in keeping the linear elements upright and/or resilient and resists crimping or bending. The cellular structure makes it possible to greatly reduce material requirement in bulk yet also provides sound, thermal and electrical insulating properties.

The linear elements also offer excellent sites for engaging a gripping element to form a self-gripping connection. For example, a gripping element such as a barbed hook 30 shown in FIGS. 2*b* and 6 or a similar gripping element can penetrate the wall of an individual cell 23 or window 27 and the movement of the gripping element 30 is restricted or restrained by the transverse partitions which define the individual cells, that is the partitions 22 shown in FIG. 1, 1*a* or 6 the seals 24 shown in FIG. 2*a*. The gripping element 30 may also engage a linear element in the area of the seal 24 as illustrated in FIG. 2*b*.

The cellular linear elements of the invention are conveniently formed by extruding flexible or resilient thermoplastic or elastomeric materials such as polyolefins for example, polyethylene and polypropylene, nylons, polyamides, polyurethanes, polysiloxanes, polyesters, polyvinyl based materials, and the like. The tubes 21 can be extruded having any profile in cross-section desired for example as illustrated in any of the figures shown in FIGS. 7*a–e*. As indicated previously, the extruded linear elements with partitions 22 or seals 24 can be post-treated for example by drawing down the linear elements to orient the molecular and crystal structure of the linear element. Such drawn down and oriented structures are shown for example in FIGS. 1*b*, 2*b* and 6.

The partitions 22 shown in FIG. 1*a* can be extruded simultaneously to form an integral structure as shown. This can be accomplished utilizing the method described in detail in my application Serial No. 328,203, filed Jan. 31, 1973, now U.S. Pat. No. 3,932,090 issued Jan. 1, 1976. Which is herein included as reference. The partitions 22 can be flat and thin or thick, crescent shaped, wavy, spiral, spiral and stepped, or hollow as illustrated in FIGS. 9*a–f* respectively. Other regular or irregular shapes can also be utilized for the partitions 22. The hollow partitions of FIG. 9*f* can be filled with a fluid or a solid if desired. In FIGS. 9*d* and *e* the internal partitions 22 are helical ribbons wherein cells can exist in the inner helix (FIG. 9*e*). The reverse structure is also possible. The structure of FIG. 9*d* can be extruded using a rotating ribbon orifice inside a tubular die.

The linear element as shown in FIG. 2*a* is crimped or squeezed to create the seals 24 at random or uniformly spaced apart sites. This can be accomplished conveniently by heat sealing, ultrasonic welding, dielectric welding, and/or adhesive bonding. Tacky, heat-sensitive and solvent activated adhesives can be used to form the seals 24. The seals 24 can be formed at regular or irregular intervals along the tube 21 and can be flat, crescent or saddle shaped, constricted to a point as in a string of sausage, or wavy as shown in FIGS. 8*a–d*, respectively.

The individual cells of a linear element of the invention formed by enlarging or blowing out sections of a capillary type tubing or by using suction selectively or by alternately blowing out and applying suction to form the respective cells and seals 24. The seals 24 can be on one side of the tubing, or they may alternate or opposite sides as shown in FIG. 15 or they can progress helically around the tube or be arranged in any other predetermined pattern. The linear filament of FIG. 15 is characterized by exceptional resilience, compressive strength and resistance to bending or creasing.

FIG. 15 shows a linear filament which incorporates the trough-shaped seals 24 shown in FIG. 8*b*. This embodiment illustrates that the seals 24 can alternate from one side of the tube to the other and can extend not only transversely to the longitudinal direction of the tube but also along the length thereof to form a trough shaped crescent sealed areas in contrast with sealed line as shown in FIG. 2*a*.

The structure shown in FIG. 15 is characterized by excellent rigidity, strength and resistance to crinkling, crimping and bending. This structure can thus be used for other than filaments in larger sizes such as tool handles of low bulk but high strength.

Other uniform or irregular configurations can be utilized for the seals 24. It should be understood that partitions 22 can be utilized with seals 24 in a random or uniform fashion in forming a cellular linear element which can also contain open and/or closed cells as indicated previously.

FIG. 3 illustrates a tubular member 21 which can be conveniently extruded in the conventional fashion with a blowing agent which expands and foams the tube on extrusion forming internal cells 23. This structure can be oriented to draw out and elongate the cells 23 as illustrated for example in FIG. 4.

Referring now to FIG. 5 it is possible to extrude tube 26 having longitudinal cells 27 in the wall thereof, divided by longitudinal partitions 22. The wall of the tube 26 shown here in transverse representation has longitudinal cells 27 which have a slender hollow channel like shape running parallel to one another in the wall of the tube 26. When the channel shaped cells 27 are cut transverse to the axis of the tube 26, a portion of a cell 27 is exposed to the outside of the formed linear element 10. The remaining cells are open to the outside but remain closed, i.e., unexposed with respect to one another. Stated, differently, when the filament is viewed from the inside, one can see the open cells and the sides of the transverse partitions which close the respective cell to one another. The cellular element 10 of FIGS. 5 and 6 comprises substantially a continuous integral plastic hollow member having internal transverse partitions 22 which divide the said member into individual cells 27 at regular or irregular intervals. The individual cells 27 are closed with respect to the adjacent cells and are open with respect to the outside of the filament. Such a tube can be cut spirally or helically as shown in FIG. 5 to form a continuous linear element having a series of ladder-like contiguous open cells as shown. This structure can also be post-treated by stretching and drawing down to orient the molecular and/or crystal structure of the extruded material to obtain a configuration such as shown in FIG. 6 for example. It is also possible to extrude the tube shown in FIG. 5 to simultaneously introduce transverse partitions along the longitudinal cells 27 in a manner indicated for FIG. 1*a* with reference to said U.S. Pat. No. 3,932,090. When helically or spirally cut, linear element would then have a series of closed cells contiguous with each other in a linear fashion.

As indicated previously FIG. 11 illustrates a multi-element device which is formed by cutting a cellular linear filament of the invention into discrete lengths and attaching same to a base 16. The discrete linear elements 10 are preferably attached in a generally upright fashion in relatively thick profusion to the base 16. The so-cut pile elements can be attached to the base 16 using known flocking techniques, weaving, tufting and the like. It is also possible to utilize the cellular linear element of the invention and a substantially continuous form. For example, a linear filament 10 can be spun in monofilament or staple form into a yarn with itself as shown in FIG. 10 or in combination with conventional filaments. Such a yarn or individual linear filament of the invention can then be woven or tufted into a base 16 as illustrated in FIG. 12 to form a carpet-like structure. The linear filaments 10 can also be incorporated into a non-woven structure as illustrated in FIG. 13, or a woven structure as illustrated in FIG. 14. It should be understood that the structures of FIGS. 11, 12, 13 and 14 can be made up wholly of linear filaments 10 of the invention or they can include conventional filaments as illustrated in FIGS. 13 and 14.

FIGS. 16 and 17 illustrate that the linear filament of the invention can be in the form of a spiral or crimped prior to being used in any of the ways described herein.

In addition, to forming all or part of a yarn and or a woven or non-woven structure, the linear elements of the invention can be used as a component of felts, filters, packaging and insulating materials, porous plastics, and as a material for reinforcing other materials such as plastics, plastic foams and the like, resulting in greatly increased properties in tension and impact.

Referring again, to FIG. 11, it should be understood that the term generally upright is intended to include pile elements inclined at an angle to the base 16 for example from about 25° up to about 90°. In some instances, it is desirable to incline the entire assembly of all of the pile elements 10 at an angle relative to the base 16 to promote self-gripping engagement for example. It should be noted that a plurality of the pile elements 10 cooperate in engaging gripping elements and effectively distribute the force over a given area thus eliminating concentration of stress. It is also possible to incorporate in the structure shown in FIG. 11, the gripping elements attached at an upright fashion to the base 16 uniformly or randomly distributed among the pile elements 10 to form a multi-element device which is hybrid in nature, that is being capable of engaging a gripping element and forming a self-gripping connection. In forming the structure illustrated in FIG. 11 any suitable type of adhesive or adhesive composition may be used to attach the pile elements 10 in an upright fashion to the base 16. Suitable adhesives include hot melt adhesives solvent activated adhesives, catalyzed room and elevated temperature hardening polymer adhesives, air hardening adhesives and the like.

What is claimed is:

1. Cellular filament comprising a substantially continuous integral plastic hollow member having internal transverse partitions which divide the said member into individual cells at intervals, at least some of the said individual cells being closed with respect to the adjacent cells and at least some of the said cells being open to the outside of the said filament.

2. Cellular filament of claim 1 wherein said intervals are regular intervals.

3. Cellular filament of claim 1 wherein said intervals are irregular intervals.

4. Cellular filament of claim 1 having a diameter in the range of about 0.0002 to about 0.05 inch.

5. Cellular filament of claim 1 wherein the partitions are transverse and integrally formed with said tubular member.

6. A non-woven material comprising the cellular filament of claim 1.

7. A woven material comprising the cellular filament of claim 1.

8. A yarn comprising the cellular filament of claim 1.

9. A tufted carpet comprising the cellular filament of claim 1.

10. Pile element cut from the cellular filament of claim 1.

11. Staple fiber cut from the cellular filament of claim 1.

12. Multi-element device comprising a plurality of the pile elements of claim 10 attached upright to a base.

13. Multi-element device of claim 12 wherein said pile elements are flocked onto said base.

14. Cellular filament of claim 1 drawn from and characterized by an axially oriented molecular and crystalline structure.

15. Cellular filament of claim 1 having a series of continuous ladder-like, open cells.

* * * * *